US008529027B2

(12) United States Patent
Harada

(10) Patent No.: US 8,529,027 B2
(45) Date of Patent: Sep. 10, 2013

(54) LIQUID EJECTING APPARATUS

(75) Inventor: Koji Harada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 271 days.

(21) Appl. No.: 12/948,685

(22) Filed: Nov. 17, 2010

(65) Prior Publication Data

US 2011/0115856 A1 May 19, 2011

(30) Foreign Application Priority Data

Nov. 18, 2009 (JP) ..... 2009-262617

(51) Int. Cl.
*B41J 2/175* (2006.01)
*B41J 2/165* (2006.01)
*B41J 2/17* (2006.01)

(52) U.S. Cl.
USPC ..... 347/85; 347/22; 347/84

(58) Field of Classification Search
USPC ..... 347/21, 22, 28, 84, 85
See application file for complete search history.

(56) References Cited

U.S. PATENT DOCUMENTS 6,273,103 B1 * 8/2001 Enz et al. ..... 347/28
2007/0146412 A1 * 6/2007 Gydesen ..... 347/28

FOREIGN PATENT DOCUMENTS

JP 2007-268997 A 10/2007

* cited by examiner

*Primary Examiner* — Jannelle M Lebron
(74) *Attorney, Agent, or Firm* — Kilpatrick Townsend & Stockton LLP

(57) ABSTRACT

A liquid ejecting apparatus includes: a liquid ejecting head; a liquid receiving section; a suction pump that is connected the liquid receiving section; a first liquid containing section that contains first liquid; a second liquid containing section that contains second liquid. When the second liquid in the liquid ejecting head is exchanged for the first liquid, the liquid ejecting head eject the liquid toward the liquid receiving section in a state in which the liquid receiving section is away from the liquid ejecting head, and when the first liquid in the liquid ejecting head is exchanged for the second liquid, the suction pump to operate in a state in which the liquid receiving section has been brought into contact with the liquid ejecting head to cover the ejection nozzles.

6 Claims, 6 Drawing Sheets

LIQUID EJECTING APPARATUS

BACKGROUND

This application claims priority to Japanese Patent Application No. 2009-262617, filed Nov. 18, 2009, the entirety of which is incorporated by reference herein.

1. Technical Field

The present invention relates to a technique for ejecting liquid through ejection nozzles.

2. Related Art

A liquid ejecting apparatus that ejects liquid such as ink from an ejection head is known in the art. A plurality of very small ejection nozzles is formed in the ejection head. Liquid (e.g., ink) that is to be ejected is contained in a dedicated container (e.g., ink cartridge). The liquid contained in the container is supplied to the ejection head through a passage. The liquid ejecting apparatus ejects the liquid supplied to the ejection head. A cap covers the ejection nozzles when they are not used for ejecting the liquid so as to prevent the moisture of the liquid from evaporating through the ejection nozzles, thereby avoiding the viscosity of the liquid from increasing.

A component having precipitating property is sometimes used as a component of liquid that is to be ejected. For example, when ink is used as the liquid that is to be ejected, pigment is sometimes used for the purpose of enhancing so-called weatherability or improving color-forming property. Pigment is not soluble in the solvent (e.g., water or alcohol) of ink and thus exists in a suspended state therein. For this reason, if ink is allowed to stand for a long period, pigment precipitates in the solvent of the ink. Because of the precipitation of the pigment, a thick part in which the concentration of the pigment is high is formed in the ink. Since the viscosity of the ink increases at the thick part, in some cases, ejection nozzles become clogged even when covered by a cap, which makes it impossible to print an image properly.

To address such a problem, the following technique has been proposed as disclosed in JP-A-2007-268997. An ink-jet printer disclosed therein uses, for printing, ink that contains a component having precipitating property (referred to as "ink having precipitating property"). Liquid that does not contain a component having precipitating property and is used for the purpose of keeping clogging-free condition has been prepared separately. When an ejection head will not be used for printing, the ink having precipitating property is discharged out of the ejection head so as to change the type of liquid in the ejection head from the ink to the clogging-free liquid. To perform printing, the clogging-free liquid is discharged out of the ejection head so as to change the type of liquid in the ejection head from the clogging-free liquid to the ink having precipitating property.

However, the above related art has a disadvantage in that, though it is possible to avoid the ejection nozzles of the ejection head from becoming clogged, after having been discharged from the ejection head, ink having precipitating property thickens or solidifies in the cap, resulting in the forming of sediment therein. The ink discharged into the cap is supposed to be drained to the outside of the cap by utilizing a force of suction applied thereto by a suction pump that is connected to the cap. However, there is a problem in that it is actually difficult to drain the ink out of the cap smoothly when the thickened or solidified ink having precipitating property blocks the inner space of the cap.

SUMMARY

An advantage of some aspects of the invention is to provide a technique for discharging ink having precipitating property from an ejection head into a cap and preventing the thickening or solidification of the discharged ink having precipitating property in the cap.

In order to provide a solution to at least a part of the problems described above, though not necessarily limited thereto, the following configuration is adopted for a liquid ejecting apparatus according to an aspect of the invention. A liquid ejecting apparatus according to a first aspect of the invention includes a liquid ejecting head, a liquid receiving section, a suction pump, a first liquid containing section, a second liquid containing section, a selective connection section, and a liquid exchanging section. The liquid ejecting head has a plurality of ejection nozzles through which liquid is ejected. The liquid receiving section receives the liquid ejected through the ejection nozzles. The liquid receiving section has a recess for receiving the liquid. The suction pump is connected to the recess of the liquid receiving section for sucking the liquid in the recess. The first liquid containing section contains first liquid to be ejected through the ejection nozzles. The second liquid containing section contains second liquid that is supplied to the liquid ejecting head to replace the first liquid for avoiding the first liquid from thickening or solidifying in the liquid ejecting head. The selective connection section selects either the first liquid containing section or the second liquid containing section and connects the selected one to the liquid ejecting head. The liquid exchanging section supplies the liquid contained in the one of the first liquid containing section and the second liquid containing section selected by the selective connection section to the liquid ejecting head so as to exchange the liquid in the liquid ejecting head. When the selected liquid is changed from the first liquid to the second liquid, the liquid exchanging section exchanges the first liquid in the liquid ejecting head for the second liquid by causing the suction pump to operate in a state in which the liquid receiving section has been brought into contact with the liquid ejecting head to form an enclosed space by means of the recess for surrounding the ejection nozzles. When the selected liquid is changed from the second liquid to the first liquid, the liquid exchanging section exchanges the second liquid in the liquid ejecting head for the first liquid by causing the liquid ejecting head to eject the liquid through the ejection nozzles toward the recess in a state in which the liquid receiving section is away from the liquid ejecting head.

A liquid exchanging method according to a second aspect of the invention is applied to a liquid ejecting apparatus according to the first aspect of the invention. The liquid exchanging method is used for exchanging liquid in a liquid ejecting head of the liquid ejecting apparatus. The liquid ejecting apparatus includes the liquid ejecting head that has a plurality of ejection nozzles through which the liquid is ejected, a liquid receiving section that receives the liquid ejected through the ejection nozzles, the liquid receiving section having a recess for receiving the liquid, a suction pump that is connected to the recess of the liquid receiving section for sucking the liquid in the recess, a first liquid containing section that contains first liquid to be ejected through the ejection nozzles, and a second liquid containing section that contains second liquid that is supplied to the liquid ejecting head to replace the first liquid for avoiding the first liquid from thickening or solidifying in the liquid ejecting head. The liquid exchanging method includes selecting either the first liquid containing section or the second liquid containing section and connecting the selected one to the liquid ejecting head. Such operation is referred to as selective connection. The liquid exchanging method further includes supplying the liquid contained in the one of the first liquid containing section and the second liquid containing section selected in the selective connection to the liquid ejecting head so as to exchange the liquid in the liquid ejecting head. Such operation is referred to as liquid exchanging. The liquid exchanging is operation of, when the liquid selected in the selective connection is changed from the first liquid to the second liquid, exchanging the first liquid in the liquid ejecting head for the second liquid by causing the suction pump to operate in a state in which the liquid receiving section has been brought into contact with the liquid ejecting head to form an enclosed space by means of the recess for surrounding the ejection nozzles, and when the liquid selected in the selective connection is changed from the second liquid to the first liquid, exchanging the second liquid in the liquid ejecting head for the first liquid by causing the liquid ejecting head to eject the liquid through the ejection nozzles toward the recess in a state in which the liquid receiving section is away from the liquid ejecting head.

With the above liquid ejecting apparatus and liquid exchanging method, it is possible to eject the first liquid through the ejection nozzles by connecting the first liquid containing section to the liquid ejecting head. When the liquid ejecting head will not be used for ejection for a long period, the second liquid containing section is connected to the liquid ejecting head to supply the second liquid thereto while disconnecting the first liquid containing section from the liquid ejecting head, thereby changing the type of liquid in the ejection head. By this means, it is possible to avoid the first liquid from thickening or solidifying in the liquid ejecting head. The meaning of "the thickening or solidifying of liquid" is not limited to the increasing of the viscosity of the liquid due to the vaporization of moisture of the liquid or volatile component thereof. The term encompasses the meaning of thickening or solidification that occurs as a result of unbalanced component concentration when a component contained in the liquid precipitates due to gravity or floats up due to buoyancy. To eject the first liquid from a state in which the second liquid is supplied to the liquid ejecting head, the first liquid containing section is connected again to the liquid ejecting head, thereby changing the type of liquid in the ejection head from the second liquid to the first liquid. In the above liquid ejecting apparatus and liquid exchanging method, the second liquid in the liquid ejecting head is exchanged for the first liquid by causing the liquid ejecting head to eject the liquid through the ejection nozzles toward the recess of the liquid receiving section in a state in which the liquid receiving section is away from the liquid ejecting head. The first liquid in the liquid ejecting head is exchanged for the second liquid by causing the suction pump to operate in a state in which the liquid receiving section has been brought into contact with the liquid ejecting head to cover the ejection nozzles.

When the first liquid in the liquid ejecting head is exchanged for the second liquid, the second liquid is sucked through the ejection nozzles after the sucking of the first liquid therethrough. The sucked liquid flows into the recess of the liquid receiving section. Since time elapsed since the discharging of the first liquid into the recess of the liquid receiving section from the liquid ejecting head is very short at the point in time at which the second liquid flows into the recess, the thickening or solidification of the first liquid has not advanced yet. As the suction pump applies a force of suction to the inner space of the recess, the first liquid is caused to flush by the second liquid. Thus, almost no first liquid will be left in the recess due to suction. Moreover, even when the ejection of liquid is not performed for a long period, since the first liquid has been almost perfectly drained to the outside of the recess of the liquid receiving section due to suction, there is no risk of the thickening or solidifying of the first liquid in the recess of the liquid receiving section. Thus, no sediment of the first liquid will be formed in the recess.

When the second liquid in the liquid ejecting head is exchanged for the first liquid, the liquid in the liquid ejecting head is ejected toward the recess of the liquid receiving section through the ejection nozzles for liquid-exchanging operation. As explained above, since no first liquid is retained in the recess of the liquid receiving section, there is no risk of the thickening or solidifying of the first liquid in the recess. Therefore, it is not necessary to apply a force of suction to the inner space of the recess by means of the suction pump. After the exchanging of the second liquid in the liquid ejecting head for the first liquid, it follows that a certain amount of the first liquid is ejected into the recess of the liquid receiving section from the ejection nozzles. However, before the ejected first liquid thickens or solidifies in the recess, ejecting operation ends with the exchanging of the first liquid in the liquid ejecting head for the second liquid. The first liquid is sucked out by the suction pump together with the second liquid during such exchanging operation. Thus, there is no risk of the thickening or solidifying of the first liquid in the recess.

Generally, liquid can be discharged with greater precision when ejected through ejected nozzles than when sucked by means of a suction pump. Therefore, when the second liquid in the liquid ejecting head is exchanged for the first liquid, it is possible to reduce the amount of the first liquid ejected wastefully from the ejection nozzles after the changing of the type of liquid in the liquid ejecting head from the second liquid to the first liquid by ejecting the liquid from the ejection nozzles. Thus, it is possible to reduce the amount of the first liquid consumed.

In a liquid ejecting apparatus according to the first aspect of the invention, it is preferable that the liquid ejecting head should have an opening of a liquid passage that is connected to the second liquid containing section; and the opening of the liquid passage should be formed at a position where the enclosed space is formed between the recess and a surface of the liquid ejecting head when the liquid receiving section has been brought into contact with the liquid ejecting head.

The liquid ejecting apparatus that includes the liquid ejecting head having such a preferred structure operates as follows to offer the following advantage. When the first liquid in the liquid ejecting head is exchanged for the second liquid, the second liquid is sucked into the recess of the liquid receiving section through the opening of the liquid passage concurrently with the sucking of the first liquid through the ejection nozzles. Since the second liquid flows into the recess of the liquid receiving section concurrently with the flowing of the first liquid into the recess instead of discharging the first liquid only into the recess, it is possible to increase the reliability of the flushing of the first liquid by using the second liquid.

In the operation of the above liquid ejecting apparatus, the discharging of the second liquid into the recess of the liquid receiving section starts no later than the completion of the discharging of the first liquid into the recess. Therefore, it is possible to make the amount of the first liquid that is left in the recess very small at the point in time at which the type of liquid in the liquid ejecting head has been changed from the first liquid to the second liquid. Therefore, it is possible to significantly reduce the amount of the second liquid required for the flushing of the first liquid retained in the recess after the changing of the type of liquid in the liquid ejecting head. For this reason, despite the fact that the discharging of the second liquid into the recess starts no later than the completion of the discharging of the first liquid into the recess, when taken as a whole, it is possible to reduce the total amount of the second liquid required for the flushing of the first liquid retained in the recess. Moreover, since the first liquid is sucked out by using the suction pump, even though the second liquid is sucked out together with the first liquid, time required for sucking the first liquid out of the liquid ejecting head will not be so long. On the other hand, time required for causing the second liquid only to flow into the recess for the flushing of the first liquid retained in the recess after the completion of the discharging of the first liquid due to suction can be significantly shortened. Thus, it is possible to shorten time required for changing the type of liquid in the liquid ejecting head from the first liquid to the second liquid inclusive of time taken for the flushing of the first liquid retained in the recess.

Instead of providing the opening of the liquid passage connected to the second liquid containing section, the liquid ejecting head of the liquid ejecting apparatus may have an ejection nozzle(s) through which the second liquid is ejected.

With the liquid ejecting apparatus that includes the liquid ejecting head having such a preferred structure, when the recess of the liquid receiving section receives the first liquid for a purpose other than for changing the type of liquid in the liquid ejecting head from the first liquid to the second liquid (for example, when the first liquid deteriorated due to the vaporization of the moisture thereof through the ejection nozzles during ejecting operation is ejected toward the recess of the liquid receiving section), it is possible to eject the second liquid toward the recess of the liquid receiving section. By this means, it is possible to prevent the first liquid ejected into the recess from thickening or solidifying by moisturizing the recess of the liquid receiving section by using the second liquid. Therefore, during the flushing of the first liquid retained in the recess of the liquid receiving section concurrent with the changing of the type of liquid in the liquid ejecting head from the first liquid to the second liquid as explained above, it is possible to ensure that the first liquid received by the recess of the liquid receiving section earlier flushes together with the first liquid sucked through the ejection nozzles.

BRIEF DESCRIPTION OF THE DRAWINGS

The invention will be described with reference to the accompanying drawings, wherein like numbers reference like elements.

DESCRIPTION OF EXEMPLARY EMBODIMENTS

In order to elucidate the technical concept of the present invention summarized as above, in the following description, exemplary embodiments of the invention are explained, which are organized into the following chapters.

A. Configuration of Apparatus

B. Processing for Exchanging Liquid in Head According to Present Embodiment

C. Variation Examples

A. Configuration of Apparatus

Figure 1:
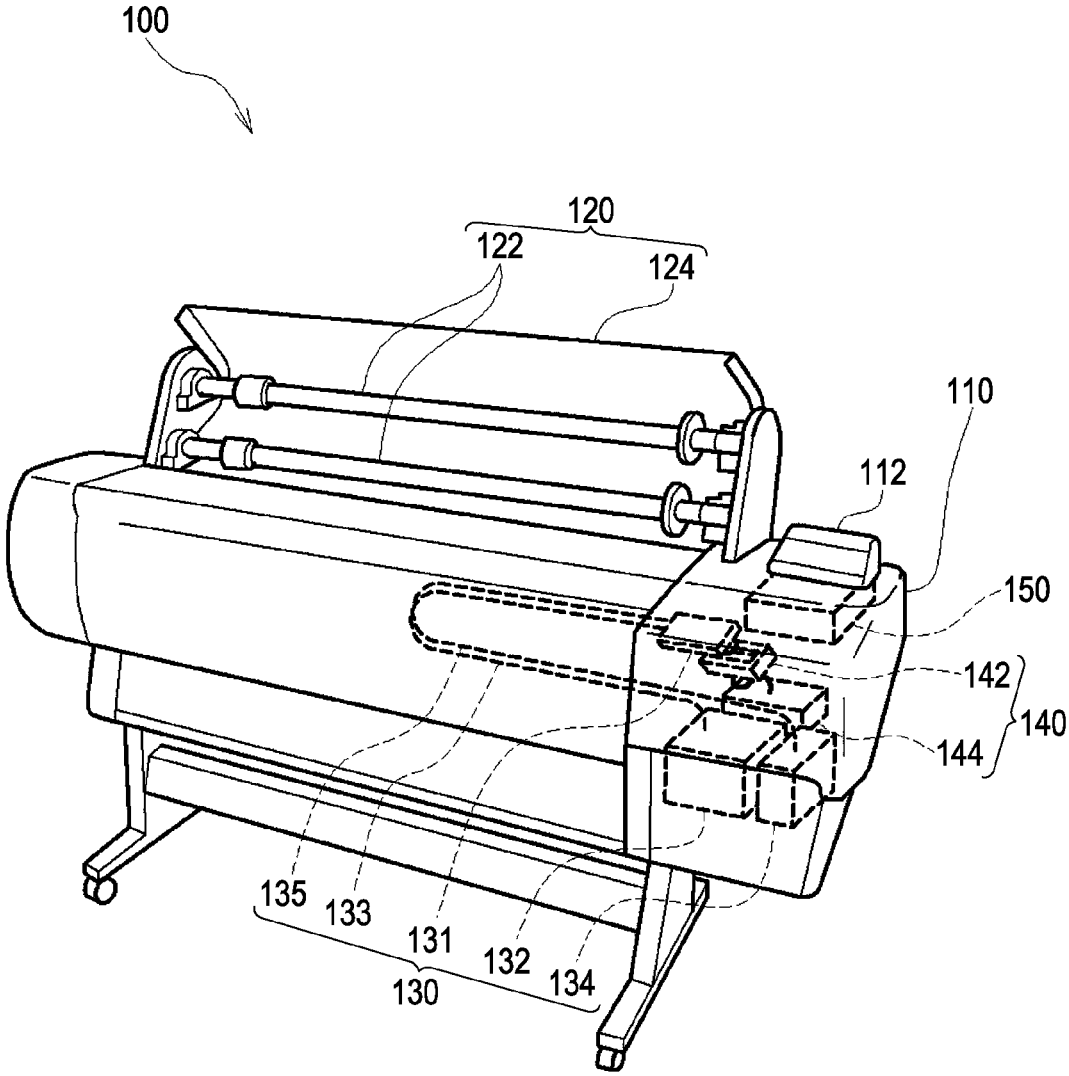
FIG. 1 is a diagram that schematically illustrates an example of the configuration of an ink-jet printer, which is an example of a liquid ejecting apparatus according to an exemplary embodiment of the invention.

FIG. 1 is a diagram that schematically illustrates an example of the configuration of an ink-jet printer 100, which is an example of a liquid ejecting apparatus according to an exemplary embodiment of the invention. The ink-jet printer 100 illustrated in FIG. 1 is a so-called large format printer (LFP), which performs printing on a sheet of printing paper that has a comparatively large size such as, for example, A1 paper or B1 paper conforming to the Japanese Industrial Standard (JIS). However, the ink-jet printer 100 may be a home-use printer, which performs printing on a sheet of printing paper that has a comparatively small size such as JIS A4 paper, postcard paper, and the like.

As illustrated in FIG. 1, the ink-jet printer 100 is roughly made up of a body case 110 and a paper supply unit 120. The paper supply unit 120 is provided on the top of the body case 110. Printing paper is loaded in the paper supply unit 120. An ink ejection unit 130, an ink maintenance unit 140, a control unit 150, and the like, are encased in the body case 110. The ink ejection unit 130 ejects ink toward printing paper. The ink maintenance unit 140 is used for keeping ink in good condition by, for example, preventing it from drying. The control unit 150 controls the entire operation of the ink-jet printer 100.

The paper supply unit 120 includes spindles 122, a cover 124, and the like. The spindle 122 is a member that has the shape of a shaft. Both of the ends of the shaft are rotatably supported. A roll of printing paper (hereinafter referred to as "roll sheet") is attached to the spindle member 122. A roll-sheet holding member that can slide in the axial direction is provided at each of the two ends of the spindle 122. The roll-sheet holding members fix the roll sheet so that it does not move in the axial direction. The cover 124 is provided for preventing the roll sheet attached to the spindle member 122 from becoming stained. The cover 124 is a flip-up member. To attach a roll sheet to the spindle 122, a user opens the flip-up cover 124 to expose the spindle 122. Then, the user takes the spindle 122 out of the paper supply unit 120 and attaches the roll sheet to the spindle 122. Next, the user sets the spindle 122 to which the roll sheet has been attached into the paper supply unit 120 and thereafter pushes down the front edge of the cover 124 to close it.

The ink ejection unit 130 includes a head 131 for ejecting ink, an ink cartridge 132 that contains ink that is to be ejected from the ejection head 131, and an ink tube 133 through which the ink contained in the ink cartridge 132 is supplied to the ejection head 131. Besides the ejection head 131, the ink cartridge 132, and the ink tube 133, the ink ejection unit 130 of the ink-jet printer 100 according to the present embodiment of the invention includes a cartridge 134 that contains liquid for preventing the clogging of the nozzles of the ejection head 131 (i.e., conditioning medium, hereinafter referred to as "clogging-free" liquid) and further includes a clogging-free liquid tube 135 through which the clogging-free liquid contained in the clogging-free liquid cartridge 134 is supplied to the ejection head 131. As mentioned above, the ejection head 131 has a plurality of very small ejection nozzles in its head surface that faces printing paper. The ejection head 131 ejects ink from the ejection nozzles to print characters, images, and the like, on printing paper.

Though not illustrated in the drawing, a selector is provided in the ejection head 131. When ink is not ejected from the ejection nozzles, clogging-free liquid is supplied to the ejection head 131 by switching the passage of flow inside the ejection head 131 by means of the selector. Since ink retained in the ejection head 131 is exchanged for clogging-free liquid, in other words, since the ink is replaced with the clogging-free liquid, it is possible to avoid the ejection nozzles from becoming clogged when printing is not performed for a long period. The above surface of the ejection head 131, which faces printing paper and has the plurality of ejection nozzles formed therein, is called as "nozzle surface". The ink-jet printer 100 uses plural types of ink such as cyan ink, magenta ink, yellow ink, black ink, white ink, and the like. The ejection head 131, the ink cartridge 132, and the ink tube 133 are provided for each of the plural types of ink. However, to simplify illustration, these components are shown for one of the plural types of ink only.

The ink maintenance unit 140 includes a cap 142, a waste ink tank 144, and the like. The cap 142 has a recess at its center. The waste ink tank 144 is a reservoir for waste ink discharged from the ejection head 131 because of deterioration in its property. The cap 142 is a member that can be brought into contact with and be released from the nozzle surface of the ejection head 131. A driving mechanism that is not illustrated in the drawing is used for moving the cap 142. During a period of time in which the printing of an image is not performed, the cap 142 is in contact with the nozzle surface. By this means, since the cap 142 seals the ejection nozzles when the ejection head 131 is not used for printing, it is possible to prevent ink from drying due to aeration through the ejection nozzle or make it less susceptible to drying. In a case where the property of ink has deteriorated because of the advancement of drying in spite of sealing, the ejection head 131 ejects the ink toward the recess of the cap 142. Alternatively, in such a case, a suction pump (not illustrated therein) is operated with the cap 142 being in contact with the nozzle surface of the ejection head 131 so as to apply negative pressure to the recess of the cap 142, thereby sucking the ink having deteriorated property out of the ejection nozzles (out of the ejection head 131 through the ejection nozzles). The ink discharged from the ejection head 131 is drained through a tube into the waste ink tank 144 functioning as a waste reservoir.

An operation panel 112 is provided on the upper surface of the body case 110. The operation panel 112 provides user interface for operating the ink-jet printer 110. The operation panel 112 includes a display screen such as a liquid crystal display screen, various buttons for operation, and the like. A user can operate the ink-jet printer 110 by manipulating the buttons while monitoring the display screen.

Though not illustrated in FIG. 1, a driving unit that supplies motor power for reciprocating the ejection head 131 opposite to the surface of printing paper, a paper-feed unit that unreels a roll sheet out of the paper supply unit 120 and feeds the unreeled roll sheet downstream, and the like, are provided inside the body case 110.

Figure 2:
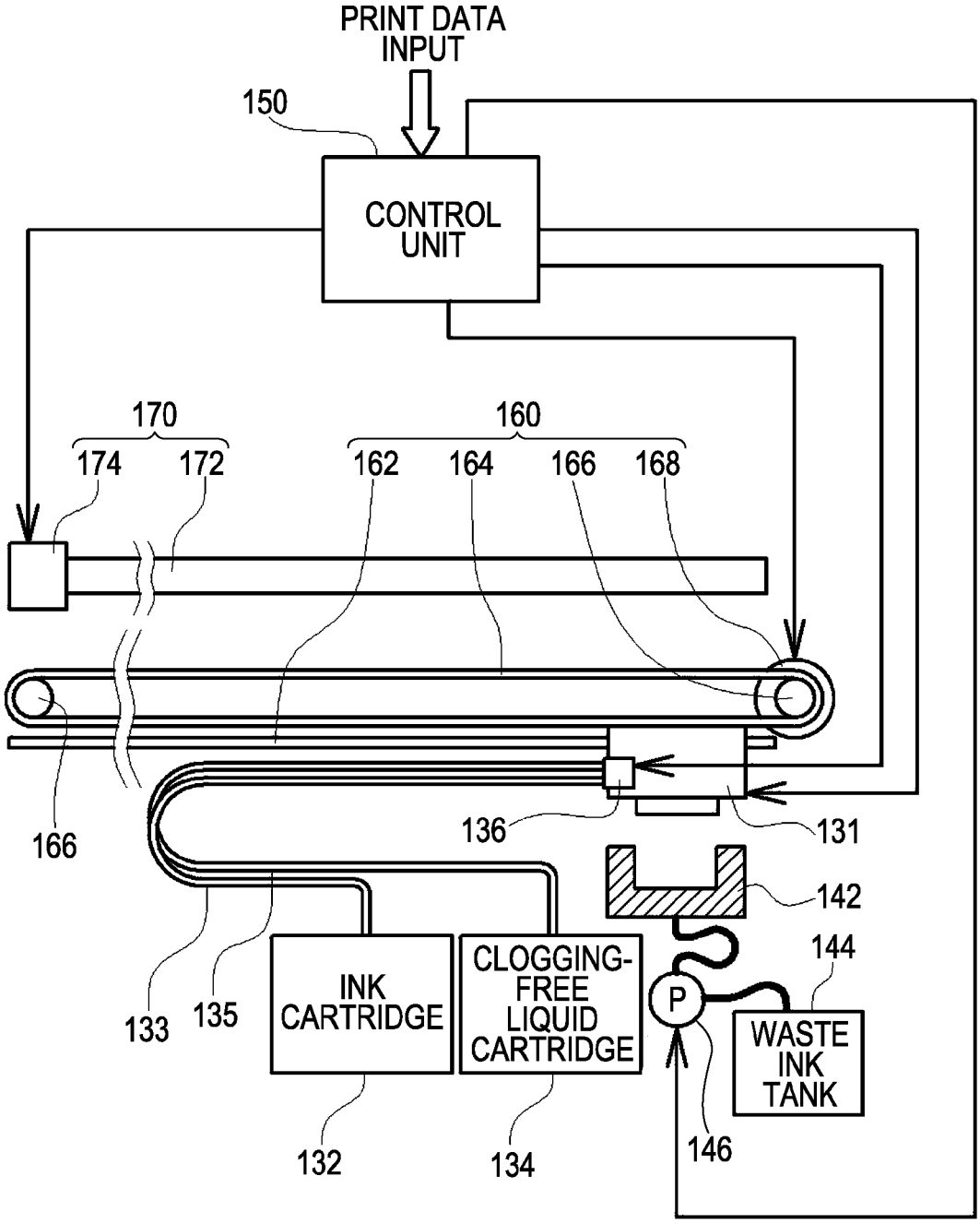
FIG. 2 is a diagram that schematically illustrates an example of the configuration of a driving unit that causes an ejection head to reciprocate and a paper-feed unit that unreels a roll sheet and feeds the unreeled roll sheet downstream according to an exemplary embodiment of the invention.

FIG. 2 is a diagram that schematically illustrates an example of the configuration of a driving unit 160, which causes the ejection head 131 to reciprocate, and a paper-feed unit 170, which unreels a roll sheet and feeds the unreeled roll sheet downstream, according to an exemplary embodiment of the invention. As illustrated in FIG. 2, the driving unit 160 includes a guide rail 162, a driving belt 164, a pair of pulleys 166, a driving motor 168, and the like. The guide rail 162 serves as a guide for reciprocation of the ejection head 131. The driving belt 164 transmits power for reciprocating the ejection head 131 along the guide rail 162. The driving belt 164 is stretched between the pair of pulleys 166. The driving motor 168 supplies power for turning the driving belt 164. The ejection head 131 is fixed to a region of the driving belt 164. When the driving motor 168 is activated in its normal/reverse direction to turn the driving belt 164, the ejection head 131 reciprocates while being guided by the guide rail 162.

The paper-feed unit 170 includes an elongated paper-feed roller 172, a paper-feed motor 174, a driven roller, and the like. The paper-feed roller 172 is provided in parallel with the guide rail 162. The paper-feed roller 172 is long enough to traverse a roll sheet in the direction of width of the sheet. The paper-feed motor 174 supplies power for rotating the paper-feed roller 172. The driven roller, which is not illustrated in the drawing, is provided along the paper-feed roller 172. The roll sheet loaded in the paper supply unit 120 is partially unreeled to the position of the paper-feed roller 172. The unreeled end of the roll sheet is inserted between the paper-feed roller 172 and the driven roller. In this state, the driven roller applies a moderate pressing force onto the pinched end region of the roll sheet against the paper-feed roller 172. When the paper-feed motor 174 is activated in such a state, the roll sheet is gradually unreeled as the paper-feed roller 172 rotates. The unreeled part of the roll sheet is fed toward the ejection head 131.

The control unit 150 controls the operation of the driving motor 168 and the operation of the paper-feed motor 174 explained above. Besides the operation of these motors, the control unit 150 controls the ejection of ink from the ejection head 131, the moving of the cap 142 so as to bring it into contact with the nozzle surface of the ejection head 131 or the activation of the suction pump in a state in which the cap 142 is in contact with the nozzle surface of the ejection head 131 for sucking ink out of the ejection nozzles. In addition, the switching of the passage of flow inside the ejection head 131 by means of a selector 136 so as to exchange ink retained in the ejection head 131 for clogging-free liquid as explained above, or exchange clogging-free liquid retained in the ejection head 131 for ink, is also performed under the control of the control unit 150. The control unit 150 is configured to receive data that is necessary for printing (hereinafter referred to as "print data") from an external device (e.g., a personal computer) connected to the ink-jet printer 100 before printing is started. Therefore, the control unit 150 can obtain information on timing as to when printing should be started and information related to a currently demanded print job (e.g., the types of ink that should be used for the printing of this time).

As explained above, the control unit 150 according to the present embodiment of the invention is involved in the controlling of every operation of the ink-jet printer 100. When print operation is started under the control of the control unit 150, the ejection head 131 ejects ink toward printing paper (i.e., roll sheet) while reciprocating along the guide rail 162.

The ejection head 131 is connected to the ink cartridge 132 through the ink tube 133, which has a sufficient length. An ink-pressurizing mechanism, which is not illustrated in the drawing, is provided for continuously supplying ink from the ink cartridge 132 to the ejection head 131 due to pressurization. After the completion of printing, the control unit 150 causes the ejection head 131 to move to the position of the cap 142 in a plan view. The control unit 150 causes the driving mechanism, which is not illustrated in the drawing, to elevate the cap 142 to bring it into contact with the nozzle surface of the ejection head 131. By this means, it is possible to seal the ejection nozzles of the ejection head 131 by using the cap 142. Thus, it is possible to prevent the property of ink from deteriorating due to the vaporization of moisture of ink, volatile component of ink, or the like, through the open regions of the ejection nozzles during a period of time in which printing is not performed.

Ink is manufactured by adding various components such as a colorant for giving color thereto, an additive for adjusting the viscosity thereof, an interfacial active agent, and the like to a solvent such as water, alcohol, or the like. Some ink is manufactured by adding, to a solvent, a component that is insoluble in the solvent. For example, unlike dye, pigment, which is a colorant that has excellent weatherability, is not soluble in water, alcohol, or the like. Therefore, pigment is suspended in a solvent due to the action of an interfacial active agent. When ink that contains pigment is allowed to stand for a long period, the pigment in a suspended state gradually precipitates due to gravity. Therefore, a thick part in which the concentration of the pigment is high and a thin part in which the concentration of the pigment is low are formed in the ink. As a result, the viscosity of the ink increases at the thick part in which the concentration of the pigment is high. Because of the increased viscosity, there is a risk that the ink clogs ejection nozzles. In this specification, a component that is not soluble in the solvent of ink and thus exists in a suspended state therein, for example, pigment, is referred to as a "component having precipitating property". Ink that contains a component having precipitating property is referred to as "ink having precipitating property". The precipitation of a component having precipitating property in ink is referred to as the "precipitation of ink".

If it is anticipated that printing will not be performed for a long period (for example, when the power of the ink-jet printer 100 is turned off) after the completion of printing with the use of ink having precipitating property (e.g., white ink), the ejection head 131 is moved to the position of the cap 142; thereafter, the selector 136 is switched so as to connect the ejection head 131 to the clogging-free liquid tube 135. When the ink retained in the ejection head 131 is discharged into the cap 142 in a state in which the ejection head 131 is connected to the clogging-free liquid tube 135, clogging-free liquid is supplied from the clogging-free liquid cartridge 134 to the ejection head 131. The exchanging of ink retained in the ejection head 131 for clogging-free liquid makes it possible to avoid the ejection nozzles of the ejection head 131 from becoming clogged even when printing is not performed for a long period. To start printing again, the selector 136 is switched so as to connect the ejection head 131 to the ink tube 133. Then, the clogging-free liquid retained in the ejection head 131 is discharged into the cap 142. As a result, ink to be used for printing (e.g., white (W) ink) is supplied from the ink cartridge 132 to the ejection head 131, which makes it ready for printing.

The components that will be affected adversely when ink having precipitating property is allowed to stand for a long period is not limited to the ejection head 131. For example, when ink retained in the ejection head 131 is exchanged for clogging-free liquid as explained above, the cap 142 receives the ink discharged from the ejection head 131. Some of the ink received by the cap 142 can be drained to the outside of the cap 142 by operating a suction pump 146, which is connected to the cap 142. However, since the ink cannot be drained perfectly by operating the suction pump 146, it is inevitable that a certain amount of the ink, for example, white ink, will be left in the cap 142 as a residue. The viscosity of the residue of the white ink in the cap 142 increases as time passes, which could cause itself to solidify. If the thickening of such a white ink residue or solidification thereof is repeated, the thickened or solidified white ink residue accumulates as sediment. Since the sediment blocks the inner space of the cap 142, it is impossible to drain ink from the cap 142 smoothly.

An exemplary embodiment of the invention provides a solution to such a problem by using the following method when changing the type of liquid in the ejection head 131.

B. Processing for Exchanging Liquid in Head According to Present Embodiment

Figure 3:
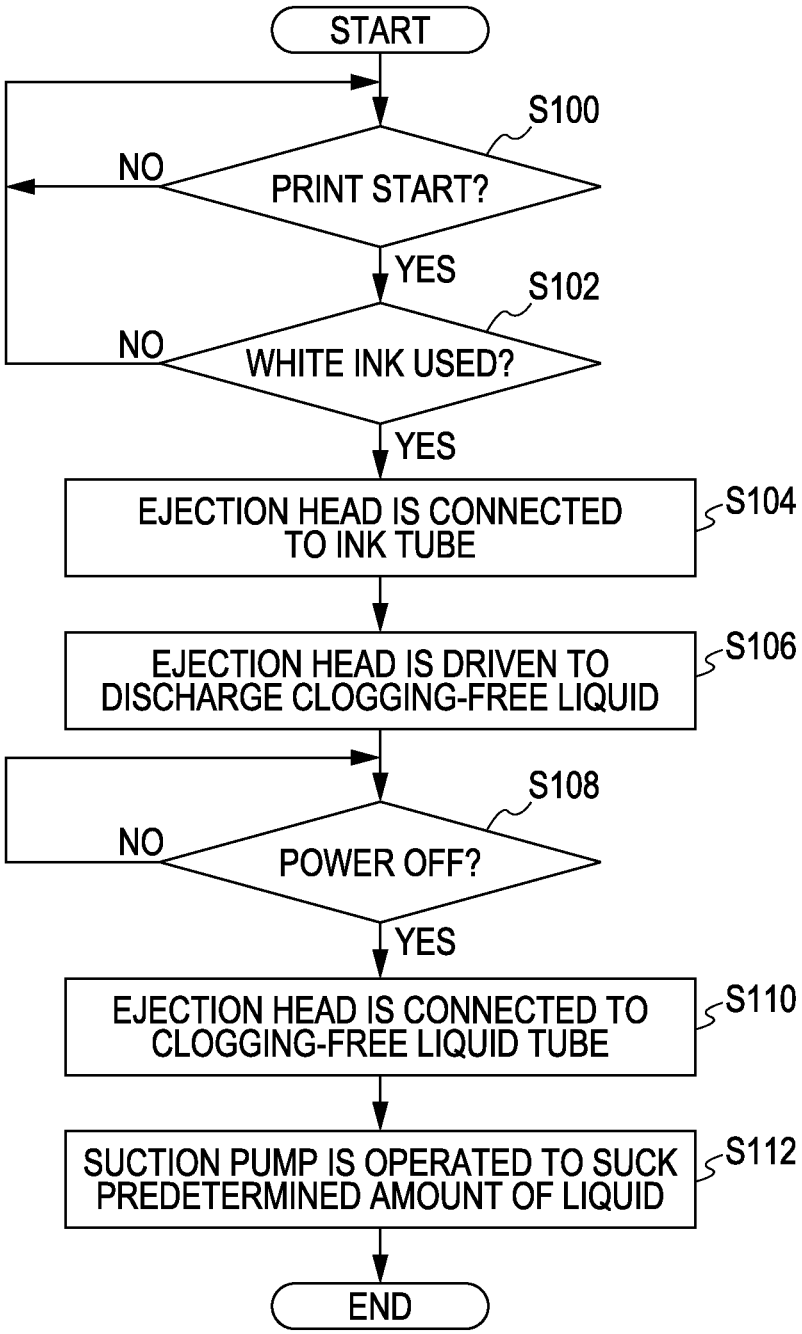
FIG. 3 is a flowchart that schematically illustrates an example of processing for exchanging liquid retained in the ejection head; the ink-jet printer according to an exemplary embodiment of the invention performs the processing.

FIG. 3 is a flowchart that schematically illustrates an example of processing for exchanging liquid retained in a head according to an exemplary embodiment of the invention. The processing for exchanging liquid retained in a head according to the present embodiment of the invention, which is hereinafter referred to as "head liquid exchanging processing", is started in response to the power activation (ON) of the ink-jet printer 100. The control unit 150, which controls the entire operation of the ink-jet printer 100 (refer to FIG. 2), performs control processing for the head liquid exchanging processing.

As a first step of the head liquid exchanging processing, the control unit 150 judges whether printing should be started now or not (step S100). As explained earlier, the control unit 150 is configured to receive print data, which contains information necessary for printing, from an external device connected to the ink-jet printer 100 before printing is started. Therefore, in the step S100, the control unit 150 judges whether printing should be started now or not depending on whether it has received such print data or not. The ink-jet printer 100 is put in a standby state if it is judged that the control unit has not received print data and thus there is not any print job that is instructed to be started now (S100: NO). The judgment in the step S100 is repeated until the control unit receives print data. If it is judged that printing should be started now (step S100: YES), the control unit 150 judges whether white ink will be used in the printing started now (hereinafter referred to as "present printing") or not (step S102).

White ink is used for special printing such as in a case where an importance should be attached to the color development (i.e., color forming) of ink. The print data received by the control unit 150 as explained above contains information as to whether such white ink will be used in the present printing or not. As described above, if it is judged that printing should be started now as indicated by the reception of the print data (step S100: YES), next, the control unit 150 judges whether white ink will be used in the present printing or not on the basis of the content of the received print data (step S102). If it is judged that white ink will not be used in the present printing (step S102: NO), it is not necessary to exchange clogging-free liquid retained in the ejection head 131 for the white ink. Therefore, in such a case, the process returns to the above step S100. In the step S100, it is judged again whether to start printing or not. If it is judged that printing should be started now as indicated by the reception of the print data (step S100: YES), next, the control unit 150 judges again whether white ink will be used in the present printing or not on the basis of the content of the received print data (step S102).

As explained above, the judgment in the steps S101 and S102 are repeated after the start of the head liquid exchanging processing until it is judged that white ink will be used for printing (step S102: YES). As explained earlier, in the present embodiment of the invention, ink retained in the ejection head 131 is exchanged for clogging-free liquid when the power of the ink-jet printer 100 is turned off. To change the type of liquid in the ejection head 131 from the ink to the clogging-free liquid, the selector 136 is switched into a state for connecting the ejection head 131 to the clogging-free liquid tube 135. Therefore, in the head liquid exchanging processing according to the present embodiment of the invention, if it is judged that white ink will be used for printing (step S102: YES), the selector 136 is switched from the above connection state into a state for connecting the ejection head 131 to the ink tube 133 (step S104). Then, the ejection head 131 is driven to discharge the clogging-free liquid retained therein toward the cap 142 (step S106).

As a result of the discharging of the clogging-free liquid retained in the ejection head 131 toward the cap 142 in the state in which the ejection head 131 is connected to the ink tube 133 (steps S104 and S106), the liquid retained in the ejection head 131 (the clogging-free liquid) is exchanged for the white ink. When the changing of the type of liquid in the ejection head 131 from the clogging-free liquid to the white ink has been completed, the ink-jet printer 100 is ready for starting printing with the use of the white ink.

In the head liquid exchanging processing according to the present embodiment of the invention, after the completion of printing, the control unit 150 judges whether the power switch of the ink-jet printer 100 has been turned off or not (step S108). The control unit 150 according to the present embodiment of the invention is connected to the power switch, which is provided on the ink-jet printer 100. Therefore, the control unit 150 knows whether the power switch is in its ON state or OFF state. The power switch is not illustrated in the drawing.

The power switch will not be switched off immediately after the completion of printing if the ink-jet printer 100 will be used for printing again. For this reason, the judgment in the step S108 is repeated until the power switch is turned off. When a user has turned the power switch off, it is judged in the step S108 of the head liquid exchanging processing that the power switch is in the OFF state.

After the lapse of a predetermined length of time since the positive judgment (YES) in the step S108, that is, the detection of power switch OFF, the supplying of power to the ink-jet printer 100 is stopped. The ink-jet printer 100 is inactive in this state. As explained earlier, if white ink, which is ink having precipitating property, were allowed to stand in the ejection head 131 for a long period during which the ink-jet printer 100 is in such an inactive state, the ejection nozzles of the ejection head 131 would become clogged. To avoid the clogging of the ejection nozzles of the ejection head 131, in the head liquid exchanging processing according to the present embodiment of the invention, if it is judged in the step S108 that the power switch has been turned off, before the ink-jet printer 100 enters the inactive state, the selector 136 is switched so as to connect the ejection head 131 to the clogging-free liquid tube 135 (step S110), followed by the activation of the suction pump 146 in a state in which the cap 142 covers the ejection nozzles of the ejection head 131 for sucking predetermined amount of liquid (step S112). In the step S112 of the head liquid exchanging processing, the suction pump 146 is activated for a certain length of time to suck predetermined amount of liquid through the ejection nozzles.

In the step S112 of the head liquid exchanging processing, the suction pump 146 is activated for a comparatively long period to suck a large amount of liquid through the ejection nozzles. Therefore, in the course of such sucking, the white ink retained in the ejection head 131 is sucked out of the ejection head 131 into the cap 142, which causes clogging-free liquid contained in the clogging-free liquid cartridge 134 to be sucked into the ejection head 131. Consequently, all of the ink retained in the ejection head 131 is exchanged for the clogging-free liquid. The head liquid exchanging processing ends after the completion of the sucking of the predetermined amount of liquid through the ejection nozzles (step S112).

In the present embodiment of the invention, since the suction pump 146 is activated for a comparatively long period in the step S112 of the head liquid exchanging processing as explained above, the sucking of the liquid through the ejection nozzles is continued for a while even after the completion of the exchanging of the ink retained in the ejection head 131 for the clogging-free liquid, which means that the clogging-free liquid is sucked through the ejection nozzles for a while thereafter. Consequently, it is possible to avoid the thickening or solidification of the white ink discharged into the cap 142, which is in contact with the ejection head 131 to cover the ejection nozzles. The reason why the thickening or solidification of the white ink can be prevented is as follows.

FIG. 4 (4A, 4B, 4C, 4D, and 4E) is a set of diagrams that schematically illustrates an example of the inner state of the cap 142 when white ink retained in the ejection head 131 is exchanged for clogging-free liquid according to an exemplary embodiment of the invention. In FIG. 4, the white ink is shown with black dots. The clogging-free liquid is shown in white.

Figure 4A:
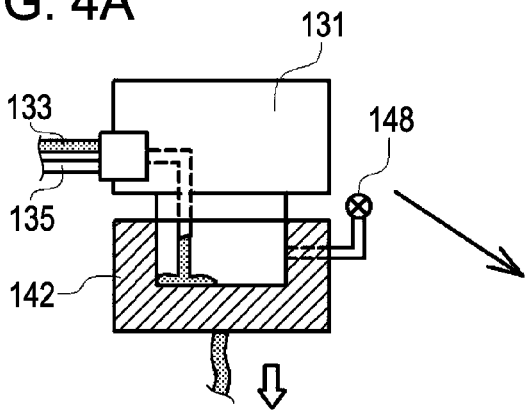
FIGS. 4A, 4B, 4C, 4D, and 4E are a set of diagrams schematically illustrating an example of the inner state of a cap when ink retained in the ejection head is exchanged for clogging-free liquid according to an exemplary embodiment of the invention.
Figure 4B:
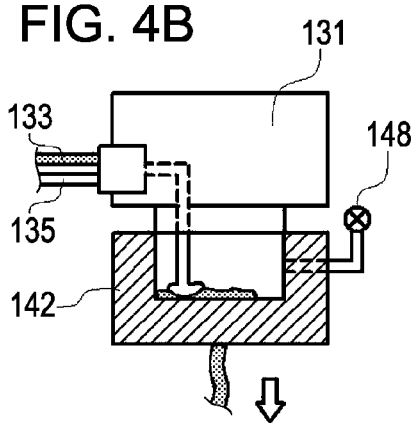
Figure 4C:
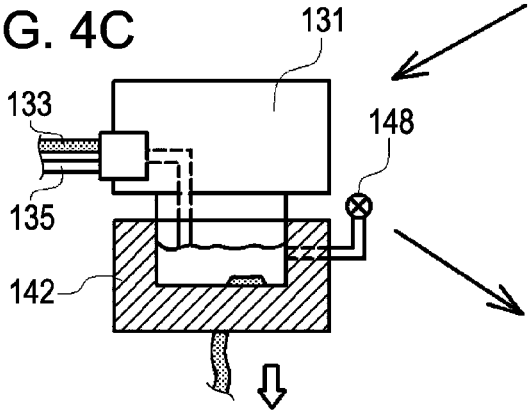

In a state in which the ejection head 131 is connected to the clogging-free liquid tube 135, the cap 142 is brought into contact with the ejection head 131 to cover the ejection nozzles as explained above. Thereafter, the suction pump 146 is activated to suck the liquid. As illustrated in FIG. 4A, the cap 142 receives the white ink sucked out of the ejection nozzles. The clogging-free liquid is supplied to the ejection head 131 to replace the white ink. As the sucking of the liquid through the ejection nozzles is continued, as illustrated in FIG. 4B, the clogging-free liquid supplied to the ejection head 131 is discharged into the cap 142. Because of the stream of the clogging-free liquid discharged into the cap 142, the flow of the liquid occurs in the cap 142. In addition, since the clogging-free liquid according to the present embodiment of the invention does not contain a pigment component and the like, it has property of diluting ink easily. For this reason, as illustrated in FIG. 4C, the white ink, which was discharged into the cap 142 earlier, is diluted with the clogging-free liquid. Especially, it is easy to dilute the white ink with the clogging-free liquid because little moisture of the white ink has escaped as vapor, which means that the thickening thereof has not advanced yet, because time elapsed since the discharging of the white ink into the cap 142 is very short at the point in time at which the clogging-free liquid is mixed in the white ink. Some of the white ink diluted with the clogging-free liquid is drained to the outside of the cap 142 through the operation of the suction pump 146 during the sucking of the clogging-free liquid through the ejection nozzles.

Figure 4D:
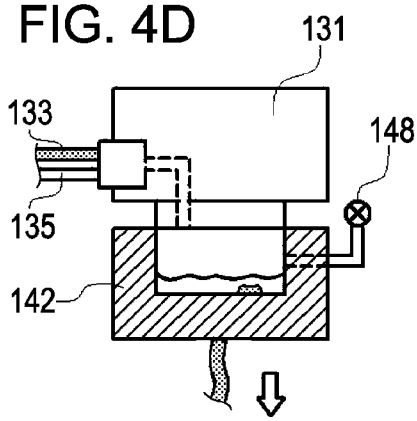
Figure 4E:
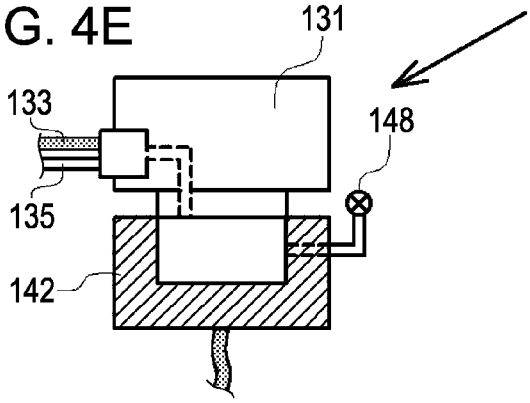

After the operation of the suction pump 146 for a predetermined length of time, as illustrated in FIG. 4D, an air open valve 148 provided in communication with the cap 142 is opened to unseal the hermetic sealing of the ejection nozzles and the cap 142. The operation of the suction pump 146 is continued in such an unsealed state so as to drain the liquid retained in the cap 142 to the outside thereof. As a result, the white ink, which was discharged into the cap 142 earlier, flushes as illustrated in FIG. 4E. The flushing ensures that the white ink will not be left in the cap 142.

As explained above, in the present embodiment of the invention, when the white ink retained in the ejection head 131 is exchanged for the clogging-free liquid, the flow of the liquid that occurs due to the sucking of the predetermined amount of liquid through the ejection nozzles is utilized for flushing before the white ink discharged into the cap 142 thickens or solidifies. By this means, it is possible to prevent the solidified white ink from accumulating as sediment in the cap 142. On the other hand, when the clogging-free liquid retained in the ejection head 131 is exchanged for the white ink as explained above, the operation of changing the type of liquid in the ejection head 131 only is performed by discharging the clogging-free liquid into the cap 142. The reason why the liquid-exchanging operation only is performed at the above point in time is as follows.

Figures 5A, 5B, 5C, 5D:
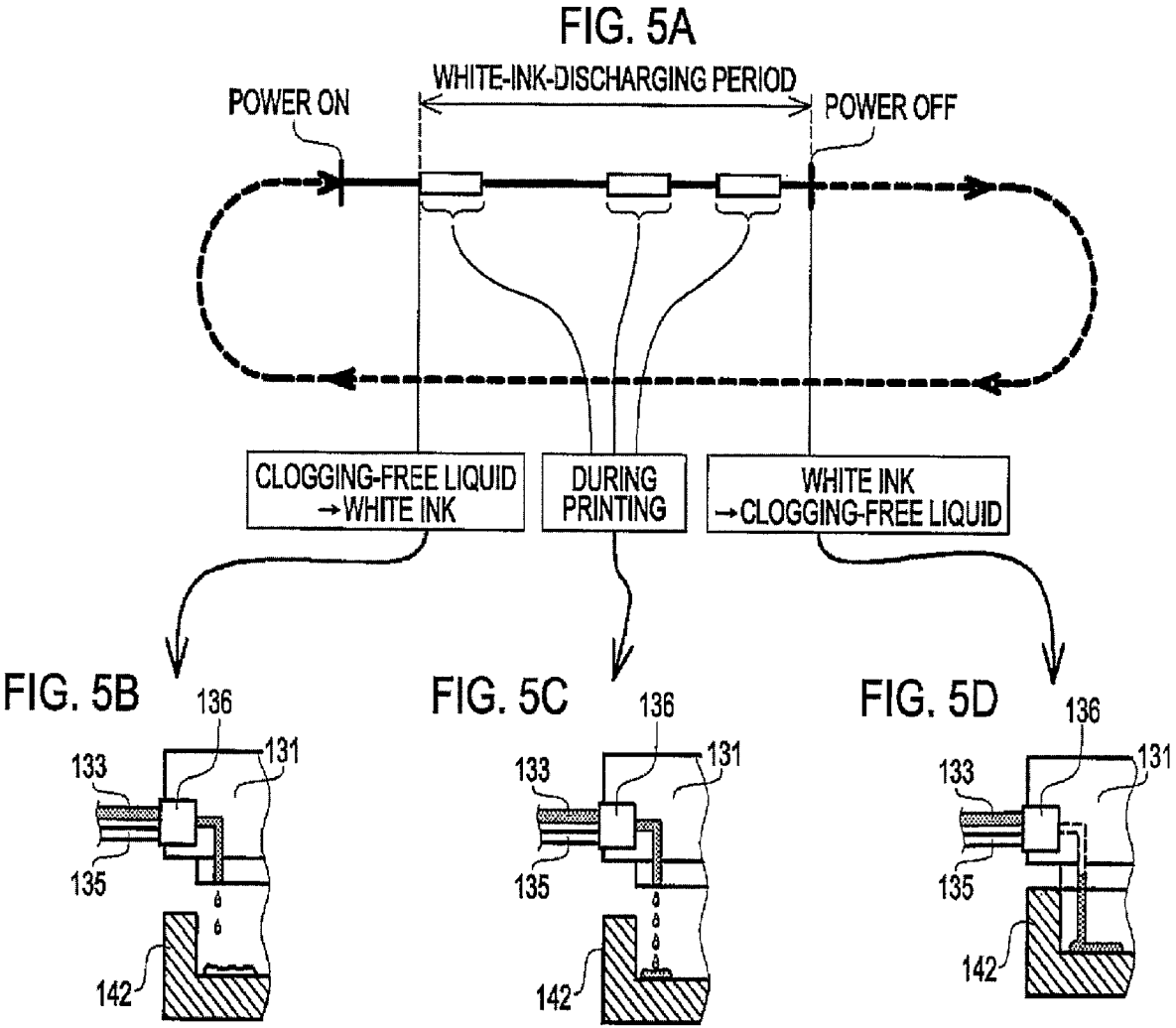
FIGS. 5A, 5B, 5C, and 5D are a set of diagrams showing the reason why the cap is flushed at a point in time at which white ink retained in the ejection head is exchanged for clogging-free liquid according to an exemplary embodiment of the invention.

FIG. 5 (5A, 5B, 5C, and 5D) is a set of diagrams that shows the reason why the cap 142 is flushed at a point in time at which white ink retained in the ejection head 131 is exchanged for clogging-free liquid according to an exemplary embodiment of the invention. FIG. 5A illustrates the operations of the ink-jet printer 100 that involve the discharging of white ink into the cap 142 during a period of time from the power ON of the ink-jet printer 100 to the power OFF thereof. The W-ink-discharging operations are shown in time series. Each of FIGS. 5B, 5C, and 5D illustrates the inner state of the cap 142 when the ink-jet printer 100 performs the corresponding operation shown in FIG. 5A.

As explained earlier, clogging-free liquid is retained in the ejection head 131 during a period of time from the power ON of the ink-jet printer 100 to the first use of white ink for printing. Therefore, white ink is never discharged toward the cap 142 during the above period. Even when it is allowed to stand for a long period, no sediment of ink will be formed in the cap 142.

When clogging-free liquid retained in the ejection head 131 is exchanged for white ink after the power of the ink-jet printer 100 is turned on as illustrated in FIG. 5A, a small amount of the white ink is discharged into the cap 142 so as to force the clogging-free liquid out of the ejection head 131 completely as illustrated in FIG. 5B.

After the exchanging of the clogging-free liquid retained in the ejection head 131 for the white ink, printing is performed by ejecting the white ink when necessary. During printing, the viscosity of the white ink increases gradually because, for example, the moisture of the white ink escapes as vapor through the ejection nozzles that are not used for printing. To suppress the thickening of the white ink during printing, as illustrated in FIG. 5C, the operation of periodically ejecting the white ink retained in the ejection head 131 is performed during printing. Therefore, the white ink is discharged into the cap 142 periodically.

Thereafter, at a point in time at which the power of the ink-jet printer 100 is turned off, to be exact, after the judgment as explained earlier, the white ink retained in the ejection head 131 is exchanged for the clogging-free liquid. In this liquid-exchanging operation, as illustrated in FIG. 5D, all of the white ink retained in the ejection head 131 is discharged into the cap 142.

As explained above, the white ink is discharged from the ejection head 131 into the cap 142 in the following timing: at the point in time at which the clogging-free liquid retained in the ejection head 131 is exchanged for the white ink, during printing, and at the point in time at which the white ink retained in the ejection head 131 is exchanged for the clogging-free liquid. The viscosity of the discharged white ink increases gradually in the cap 142. Therefore, when the white ink retained in the ejection head 131 is exchanged for the clogging-free liquid, a larger amount of liquid (i.e., the white ink and the clogging-free liquid) than necessary for the exchanging thereof is sucked, thereby causing the white ink retained in the cap 142 to flush. Since the white ink retained in the cap 142 flushes, which means that the white ink will not be left in the cap 142, even when it is allowed to stand for a long period thereafter, no sediment of the white ink will be formed in the cap 142. It is sufficient to perform the above operation for the flushing of the white ink retained in the cap 142 by using the clogging-free liquid when the white ink retained in the ejection head 131 is exchanged for the clogging-free liquid upon the detection of the power OFF of the ink-jet printer 100. By this means, the white ink is allowed to flush by means of the clogging-free liquid before the thickening of the white ink advances in the cap 142. Thus, it is possible to perform white-ink flushing operation efficiently. The efficient white-ink flushing operation minimizes the amount of the clogging-free liquid used to flush the cap 142. Therefore, it is possible to reduce the amount of the clogging-free liquid consumed.

C. Variation Examples

In the foregoing embodiment of the invention, it is explained that clogging-free liquid used for flushing the cap 142 is supplied to the cap 142 through ejection nozzles used for ejecting white ink after the discharging of the white ink retained in the ejection head 131. However, the scope of the invention is not limited to such an exemplary structure. For example, a dedicated opening (e.g., passage) that is used only for supplying clogging-free liquid to the cap 142 may be formed in the ejection head 131 separately from ejection nozzles used for ejecting white ink.

Figure 6A:
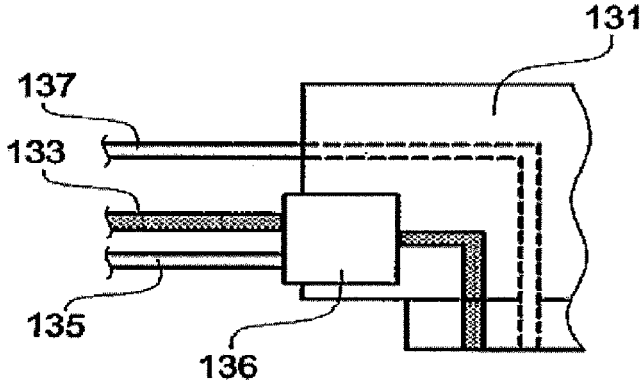
FIGS. 6A, 6B, and 6C are a set of diagrams schematically illustrating the flushing of the cap in the ink-jet printer according to a variation example of the invention.
Figure 6B:
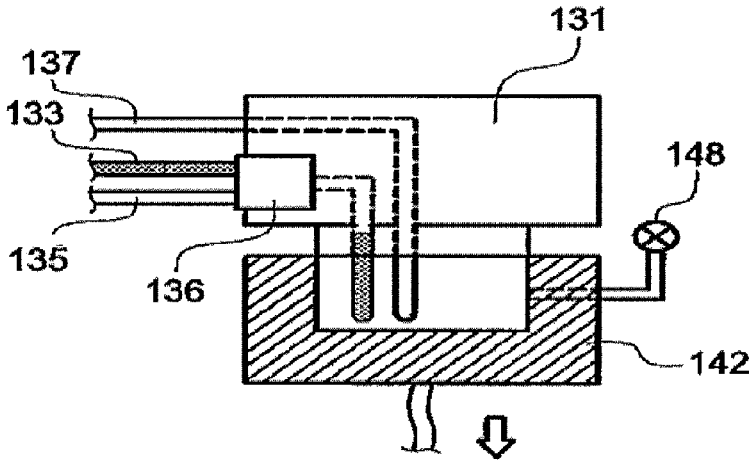
Figure 6C:
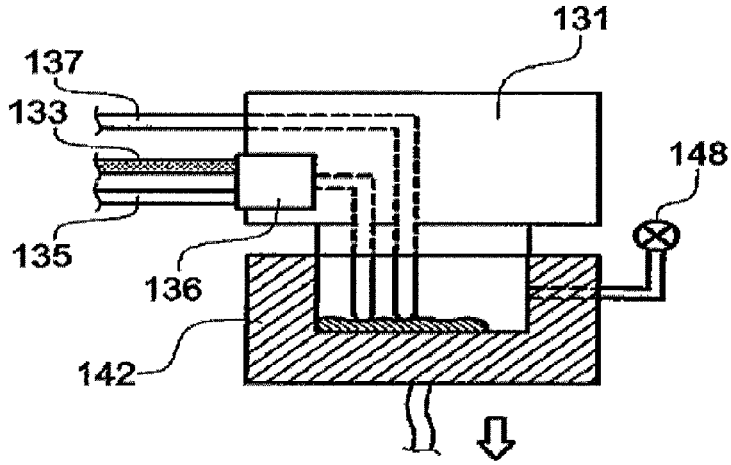

FIG. 6 (6A, 6B, and 6C) is a set of diagrams that schematically illustrates the flushing of the cap 142 in the ink-jet printer 100 according to a variation example of the invention. FIG. 6A illustrates the ejection head 131 and its peripheral components. Each of FIGS. 6B and 6C illustrates an example of the inner state of the cap 142 when white ink retained in the ejection head 131 is exchanged for clogging-free liquid.

As illustrated in FIG. 6A, a dedicated passage that is used only for supplying clogging-free liquid to the cap 142 (hereinafter referred to as "dedicated opening for clogging-free liquid") is formed in the ejection head 131 separately from ejection nozzles used for ejecting white ink. A second clogging-free liquid tube 137 through which clogging-free liquid flows into the dedicated opening for clogging-free liquid is connected to the ejection head 131. Note that the second clogging-free liquid tube 137 is not an indispensable component. In place of the second clogging-free liquid tube 137, the clogging-free liquid tube 135 may have a branch portion through which clogging-free liquid flows into the dedicated opening for clogging-free liquid.

The ejection head 131 having the structure illustrated in FIG. 6A operates as follows. When white ink retained in the ejection head 131 is exchanged for clogging-free liquid, as illustrated in FIG. 6B, the clogging-free liquid is sucked through the dedicated opening for clogging-free liquid into the cap 142 concurrently with the sucking of the white ink through the ejection nozzles into the cap 142. Therefore, it is possible to start the mixing of the white ink and the clogging-free liquid discharged into the cap 142 at an earlier point in time. The speedy mixture makes it easier to dilute the white ink with the clogging-free liquid. Therefore, it is possible to avoid the white ink from being left as a residue due to, for example, adhesion to the inner wall of the cap 142 more reliably.

As illustrated in FIG. 6B, the discharging of the clogging-free liquid into the cap 142 starts no later than the completion of the discharging of the white ink into the cap 142. Therefore, it is possible to make the amount of the white ink that is left in the cap 142 very small at the point in time at which the type of liquid in the ejection head 131 has been changed from the white ink to the clogging-free liquid. Therefore, it is possible to significantly reduce the amount of the clogging-free liquid required for the flushing of the white ink retained in the cap 142 after the changing of the type of liquid in the ejection head 131. For this reason, despite the fact that the discharging of the clogging-free liquid into the cap 142 starts no later than the completion of the discharging of the white ink into the cap 142, when taken as a whole, it is possible to reduce the total amount of the clogging-free liquid required for the flushing of the white ink retained in the cap 142. Moreover, after the completion of the discharging of all of the white ink retained in the ejection head 131 into the cap 142, as illustrated in FIG. 6C, the clogging-free liquid is sucked into the cap 142 not only from the dedicated opening for clogging-free liquid but also from the ejection nozzles. Therefore, time required for causing the clogging-free liquid only to flow into the cap 142 for the flushing of the white ink retained in the cap 142 after the completion of the discharging of the white ink due to suction can be significantly shortened. Thus, it is possible to shorten time taken for the flushing of the white ink retained in the cap 142.

In the above variation example, it is explained that a dedicated passage that is used only for supplying clogging-free liquid to the cap 142 is formed in the ejection head 131 as the dedicated opening for clogging-free liquid. However, the dedicated opening for clogging-free liquid is not limited to such a passage. Ejection nozzles through which the ejection head 131 can eject clogging-free liquid may be formed as the dedicated opening for clogging-free liquid. Such a structure produces the following effects in addition the above advantageous effects. For example, white ink discharged into the cap 142 can be diluted with clogging-free liquid by discharging the clogging-free liquid concurrently at the time of discharging the white ink that has deteriorated property due to drying during printing as explained earlier. The concurrent discharging of the white ink and the clogging-free liquid makes it possible to keep the thickening of the white ink in the cap 142 from advancing, meaning that the viscosity of the white ink does not increase during the process. Therefore, when the white ink retained in the ejection head 131 is exchanged for the clogging-free liquid, it is easier to cause the white ink retained in the cap 142 to flush by means of the clogging-free liquid sucked through the ejection nozzles.

Though exemplary embodiments of the present invention are described above, the scope of the invention is not limited to the examples described herein. The invention can be modified in various ways within a range not departing from the gist thereof.

What is claimed is:

1. A liquid ejecting apparatus comprising:

a liquid ejecting head that has an ejection nozzle through which liquid is ejected;

a liquid receiving section that receives the liquid ejected through the ejection nozzle, the liquid receiving section having a recess for receiving the liquid;

a suction pump that is connected to the recess of the liquid receiving section for sucking the liquid in the recess;

a first liquid containing section that contains first liquid to be ejected through the ejection nozzle;

a second liquid containing section that contains second liquid, having a property of diluting the first liquid, wherein the second liquid is supplied to the liquid ejecting head to replace the first liquid;

a selective connection section that selects either the first liquid containing section or the second liquid containing section and connects the selected one to the liquid ejecting head; and a liquid exchanging section that exchanges the liquid in the liquid ejecting head, when the liquid containing section selected in the selective connection section is changed from the first liquid containing section to the second liquid containing section, exchanging the first liquid in the liquid ejecting head for the second liquid by causing the suction pump to operate in a state in which the liquid receiving section has been brought into contact with the liquid ejecting head to form an enclosed space by the recess, and when the liquid containing section selected in the selective connection section is changed from the second liquid containing section to the first liquid containing section, exchanging the second liquid in the liquid ejecting head for the first liquid by causing the liquid ejecting head to eject the liquid through the ejection nozzle toward the recess of the liquid receiving section.

2. The liquid ejecting apparatus according to claim 1, wherein the liquid exchanging section exchanges the first liquid in the liquid ejecting head for the second liquid when a power switch of the liquid ejecting apparatus is turned off, and the liquid exchanging section exchanges the second liquid in the liquid ejecting head for the first liquid when the power switch is turned on.

3. The liquid ejecting apparatus according to claim 1, wherein the second liquid does not contain a pigment.

4. The liquid ejecting apparatus according to claim 1, wherein the liquid ejecting head has an opening of a liquid passage that is connected to the second liquid containing section; and the opening of the liquid passage is formed at a position around which the enclosed space is formed by the recess when the liquid receiving section has been brought into contact with the liquid ejecting head.

5. The liquid ejecting apparatus according to claim 2, wherein the opening of the liquid passage is an ejection nozzle through which the second liquid is ejected.

6. A liquid exchanging method to be applied to a liquid ejecting apparatus for exchanging liquid in a liquid ejecting head of the liquid ejecting apparatus, the liquid ejecting apparatus including the liquid ejecting head that has an ejection nozzle through which the liquid is ejected, a liquid receiving section that receives the liquid ejected through the ejection nozzle, the liquid receiving section having a recess for receiving the liquid, a suction pump that is connected to the recess of the liquid receiving section for sucking the liquid in the recess, a first liquid containing section that contains first liquid to be ejected through the ejection nozzle, and a second liquid containing section that contains second liquid having a property of diluting the first liquid, wherein the second liquid is supplied to the liquid ejecting head to replace the first liquid, the liquid exchanging method comprising:

selecting either the first liquid containing section or the second liquid containing section and connecting the selected one to the liquid ejecting head, the operation being referred to as selective connection; and exchanging the first liquid in the liquid ejecting head for the second liquid by causing the suction pump to operate in a state in which the liquid receiving section has been brought into contact with the liquid ejecting head to form an enclosed space by the recess, when the liquid containing section selected in the selective connection is changed from the first liquid containing section to the second liquid containing section, and exchanging the second liquid in the liquid ejecting head for the first liquid by causing the liquid ejecting head to eject the liquid through the ejection nozzle toward the recess of the liquid receiving section, when the liquid containing section selected in the selective connection is changed from the second liquid containing section to the first liquid containing section.

* * * * *